US006860719B2

(12) United States Patent
Burdgick

(10) Patent No.: US 6,860,719 B2
(45) Date of Patent: Mar. 1, 2005

(54) METHOD AND APPARATUS FOR SEALING TURBINE CASING

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 95 days.

(21) Appl. No.: 10/248,955

(22) Filed: Mar. 5, 2003

(65) Prior Publication Data

US 2004/0175262 A1 Sep. 9, 2004

(51) Int. Cl.[7] ..... F01D 11/00

(52) U.S. Cl. ..... 415/174.2; 415/231; 277/642; 277/647

(58) Field of Search ..... 415/100, 101, 415/103, 174.2, 174.5, 170.1, 230, 231; 277/641, 642, 647

(56) References Cited

U.S. PATENT DOCUMENTS 1,625,541 A * 4/1927 Hodgkinson ..... 415/136
3,942,804 A 3/1976 Andress et al.
5,076,591 A 12/1991 Gentile
5,253,875 A 10/1993 Gentile
5,355,909 A 10/1994 Smith, III
5,411,365 A 5/1995 Mazzola et al.
6,042,337 A * 3/2000 Thyberg ..... 416/146 A
6,286,840 B1 9/2001 Zettel
6,349,467 B1 2/2002 Karafillis et al.

* cited by examiner

*Primary Examiner*—Edward K. Look
*Assistant Examiner*—Dwayne J White
(74) *Attorney, Agent, or Firm*—Armstrong Teasdale LLP

(57) ABSTRACT

A method and apparatus for sealing between an inner casing and an outer casing is provided. The method includes positioning a first sealing member in a leakage path defined between an inner casing and an outer casing such that leakage flow in a first direction activates the first sealing member, and positioning a second sealing member in the leakage path such that leakage flow in the first direction bypasses the second sealing member, and such that leakage flow in an opposite second direction activates the second sealing member. The apparatus includes a pair of circumferential grooves in a channel, a divider positioned in the channel that defines a leakage path, a first sealing member positioned to seal against a flow in the leakage path in a first direction, and a second sealing member positioned to seal against a flow in the leakage path in a second direction.

20 Claims, 3 Drawing Sheets

METHOD AND APPARATUS FOR SEALING TURBINE CASING

BACKGROUND OF INVENTION

This invention relates generally to steam turbines, and more particularly, to controlling steam leakage paths in the turbine.

A steam turbine may include a high-pressure (HP) turbine section, an intermediate-pressure (IP) turbine section, and a low-pressure (LP) turbine section that each include rotatable steam-turbine blades fixedly attached to, and radially extending from, a steam-turbine shaft that is rotatably supported by bearings. The bearings may be located longitudinally outwardly from the high and intermediate-pressure turbine sections. A steam pressure drop through at least some known high-pressure and/or intermediate-pressure turbine sections is at least about 2,000 kPa (kiloPascals), and a difference in pressure of the steam entering the high and intermediate-pressure turbine sections is at least about 600 kPa. In some known steam turbines, steam exiting the HP turbine section is reheated by a boiler before entering the IP turbine section.

A steam turbine has a defined steam path which includes, in serial-flow relationship, a steam inlet, a turbine, and a steam outlet. Steam leakage, either out of the steam path, or into the steam path, from an area of higher pressure to an area of lower pressure, may adversely affect an operating efficiency of the turbine. For example, steam-path leakage in the turbine between a rotating rotor shaft of the turbine and a circumferentially surrounding turbine casing, may lower the efficiency of the turbine leading to increased fuel costs. Additionally, steam-path leakage between a shell and the portion of the casing extending between adjacent turbines, for example, a high pressure turbine section to an adjacent intermediate turbine section, may lower the operating efficiency of the steam turbine and over time, may lead to increased fuel costs.

To facilitate minimizing steam-path leakage between the HP turbine section and a longitudinally-outward bearing, and/or between the IP turbine section and a longitudinally-outward bearing, at least some known steam turbines use a plurality of labyrinth seals. Such labyrinth seals include longitudinally spaced-apart rows of labyrinth seal teeth. Many rows of teeth are used to seal against the high-pressure differentials that may be in a steam turbine. Brush seals may also be used to minimize leakage through a gap defined between two components, such as leakage that is flowing from a higher pressure area to a lower pressure area. Brush seals provide a more efficient seal than labyrinth seals, however, at least some known steam turbines, which rely on a brush seal assembly between turbine sections and/or between a turbine section and a bearing, also use at least one standard labyrinth seal as a redundant backup seal for the brush seal assembly.

Other areas of steam path leakage within a turbine may affect adversely turbine efficiency. One such area is a casing fit between the HP turbine section and the IP section where labyrinth and brush seals are impractical.

SUMMARY OF INVENTION

In one aspect, a method of assembling a steam turbine is provided. The method includes positioning a first sealing member in a leakage path defined between an inner casing and an outer casing such that leakage flow in a first direction activates the first sealing member, and positioning a second sealing member in the leakage path such that leakage flow in the first direction bypasses the second sealing member, and such that leakage flow in an opposite second direction activates the second sealing member.

In another aspect, a seal assembly for sealing a leakage path is provided. The seal assembly includes a first groove defined in a channel, a second groove defined in the channel and substantially parallel to the first groove wherein the second groove is defined radially outward from the first groove, a divider positioned in the channel such that a gap defined between the divider and the channel defines a leakage path, a first sealing member that extends at least partially within the first groove and positioned to substantially prevent a flow within the leakage path in a first direction, and a second sealing member that extends at least partially within the second groove and positioned to substantially prevent a flow within the leakage path in a second direction, the second direction being opposite to the first direction.

In yet another aspect, a rotary machine is provided. The rotary machine includes a rotor rotatable about a longitudinal axis and including an outer annular surface, an annular outer casing including an inner surface wherein the outer casing is spaced radially outwardly from the rotor, the casing inner surface includes a first extension extending radially inwardly towards the rotor, and the first extension extends circumferentially about the casing inner surface. The rotary machine also includes a cylindrical inner casing includes an outer surface wherein the outer surface includes a second extension extending radially towards the outer casing, and the second extension extends circumferentially about the outer surface, and the second extension includes a channel in an outer extension surface for receiving the first extension when the outer casing and the inner casing are assembled, a first groove formed in said channel sized to receive a sealing member, and a sealing member positioned at least partially within the first groove for sealing a leakage path.

DETAILED DESCRIPTION

Figure 1:
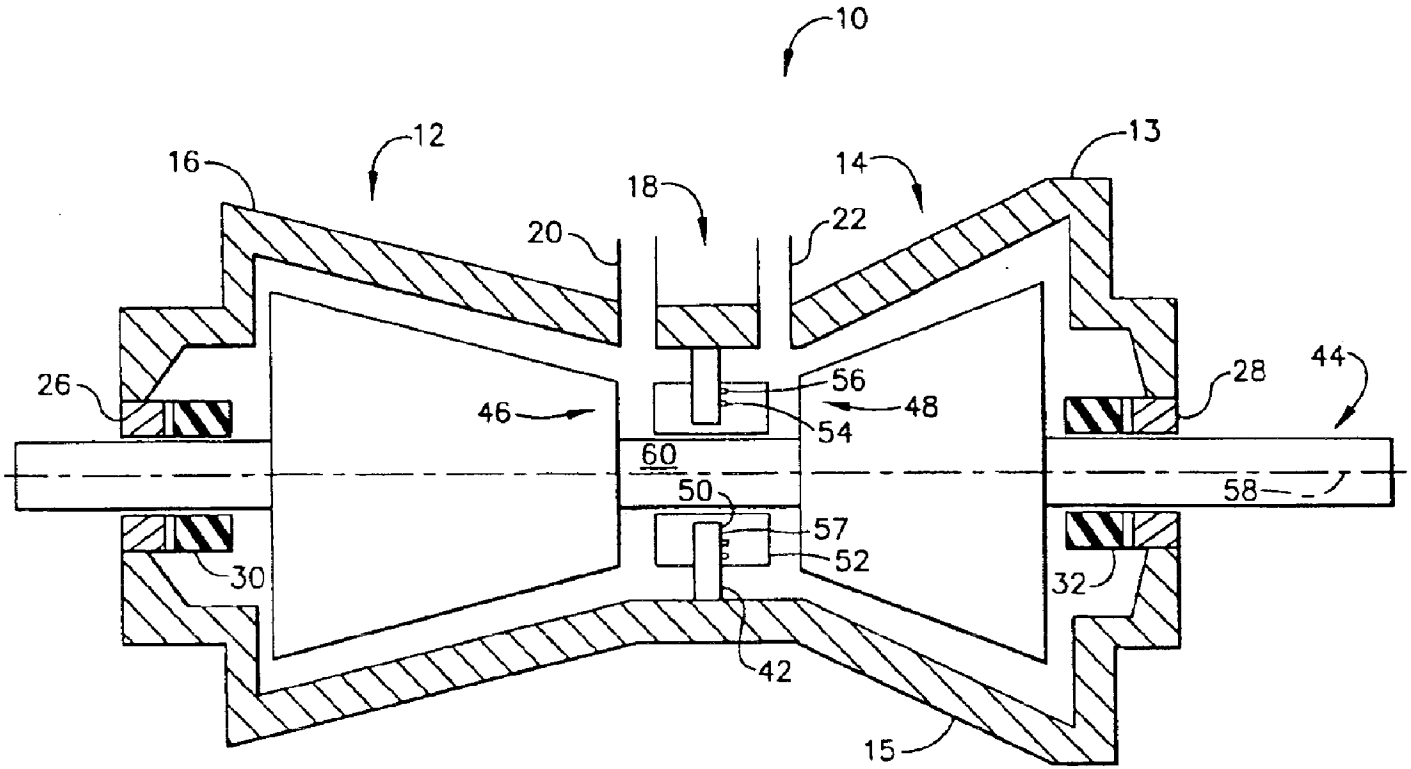
FIG. 1 is a schematic illustration of an exemplary opposed flow HP/IP steam turbine.

FIG. 1 is a schematic illustration of an exemplary opposed-flow steam turbine 10 including a high pressure (HP) section 12 and an intermediate pressure (IP) section 14. A single outer shell or casing 16 is divided axially into upper and lower half sections 13 and 15, respectively, and spans both HP section 12 and IP section 14. A central section 18 of shell 16 includes a high pressure steam inlet 20 and an intermediate pressure steam inlet 22. Within outer shell or casing 16, HP section 12 and IP section 14 are arranged in a single bearing span supported by journal bearings 26 and 28. A steam seal unit 30 and 32 is located inboard each journal bearing 26 and 28, respectively.

An annular section divider 42 extends radially inwardly from central section 18 and towards a rotor shaft 44 extending between HP section 12 and IP section 14. More specifically, divider 42 extends circumferentially around a portion of shaft 44 extending between first HP section nozzle 46 and a first IP section nozzle 48. Section divider 42 is received in a channel 50 formed in packing casing 52. Channel 50 is a C-shaped channel that extend radially into packing casing 52 and around an outer circumference of packing casing 52, such that a center opening of channel 50 faces radially outwardly. Channel 50 includes a pair of seal grooves 54 and 56 positioned in a radially extending surface 57 of channel 50. Seal grooves 54 and 56 are co-axial about a longitudinal axis 58 of turbine 10. In an alternative embodiment, section divider 42 includes a pair of seal grooves 54 and 56 positioned in a radially extending surface 59 of section divider 42.

In operation, high pressure steam inlet 20 receives high pressure/high temperature steam from a source, for example, a power boiler (not shown). The steam is routed through HP section 12 wherein work is extracted from the steam to rotate rotor shaft 44. The steam exits HP section 12 and returns to the boiler where it is reheated. The reheated steam is then routed to intermediate pressure steam inlet 22 and returned to IP section 14 at a reduced pressure than steam entering HP section 12, but at a temperature that is substantially similar to the steam entering HP section 12. Accordingly, an operating pressure within HP section 12 is higher than an operating pressure in IP section 14. Therefore, steam within HP section 12 tends to flow towards IP section 14 through leakage paths that may develop between HP section 12 and IP section 14. One such leakage path may be defined along a rotor 44 extending through packing casing 52. Accordingly, packing casing 52 includes a plurality of labyrinth and/or brush seals to facilitate reducing leakage from HP section 12 to IP section 14 along a shaft 60. Another leakage path between HP section 12 and IP section 14 is through a gap between section divider 42 and packing casing 52 in channel 50.

Figure 2:
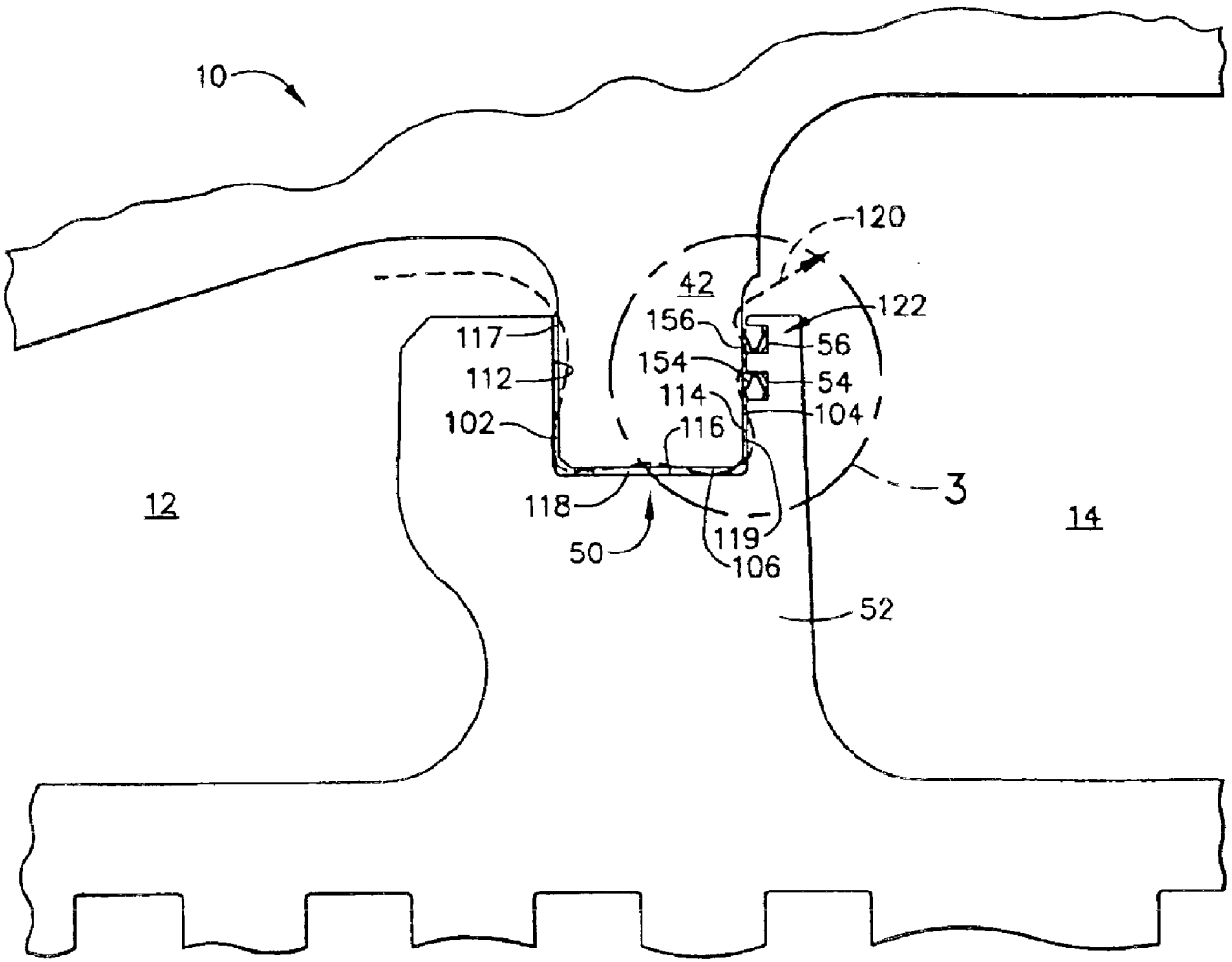
FIG. 2 is an enlarged schematic illustration of a section divider and mating channel that may be included in the steam turbine shown in FIG. 1.

FIG. 2 is an enlarged schematic illustration of a section divider 42 and channel 50 that may be included in steam turbine 10. Section divider 42 includes a first side 102, a sealing side 104, and a joining side 106. Channel 50 includes a first side 112, a sealing side 114, and a joining side 116. First sides 102 and 112 of section divider 42 and channel 50, respectively, correspond with each other in a mating fashion when section divider 42 and channel 50 are coupled. Sealing sides 104 and 114, and joining sides 106 and 116, similarly mate together when section divider 42 and channel 50 are coupled. Since sides 102, 104, and 106 do not mate exactly to sides 112, 114, and 116, a plurality of gaps 117, 118, and 119 are formed between corresponding sides, 102 and 112, 106 and 116, and 104 and 114, respectively. More specifically, each gap 117, 118, and 119 form a potential steam flow leakage path 120 from HP section 12 towards IP section 14. During some known conditions, such as a trip of turbine 10, an operating pressure in IP section 14 may exceed the pressure HP section 12 and in such a condition, the flow in leakage path 120 would tend to reverse and flow from IP section 14 towards HP section 12. To facilitate reducing leakage flow through leakage path 120, a dual opposing seal assembly 122 is provided in seal side 114. In an alternative embodiment, the dual opposing seal may be provided in surface 59 of divider 42.

Two parallel grooves 54 and 56 are formed in seal side 114 and grooves 54 and 56 are each sized to receive a sealing member 154 and 156, respectively, therein. More specifically, seal assembly 122 includes members 154 and 156, and is a pressure activated sealing member that is configured such that a pressure being sealed provides a motive force to cause the sealing member to seal tighter as pressure applied to the sealing member increases. In the exemplary embodiment, sealing members 154 and 156 are V-seals, such that each has a V-shaped cross-sectional profile. In other embodiments, sealing members 154 and 156 are known C-seals, E-seals, or W-seals.

In operation, steam at higher pressure in HP section 12 tends to leak through steam path 120 to IP section 14, which is at a lower steam pressure. Sealing members 154 and 156 seated in grooves 54 and 56 respectively, activate to facilitate limiting or stopping steam leakage flow through leakage path 120.

Figure 3:
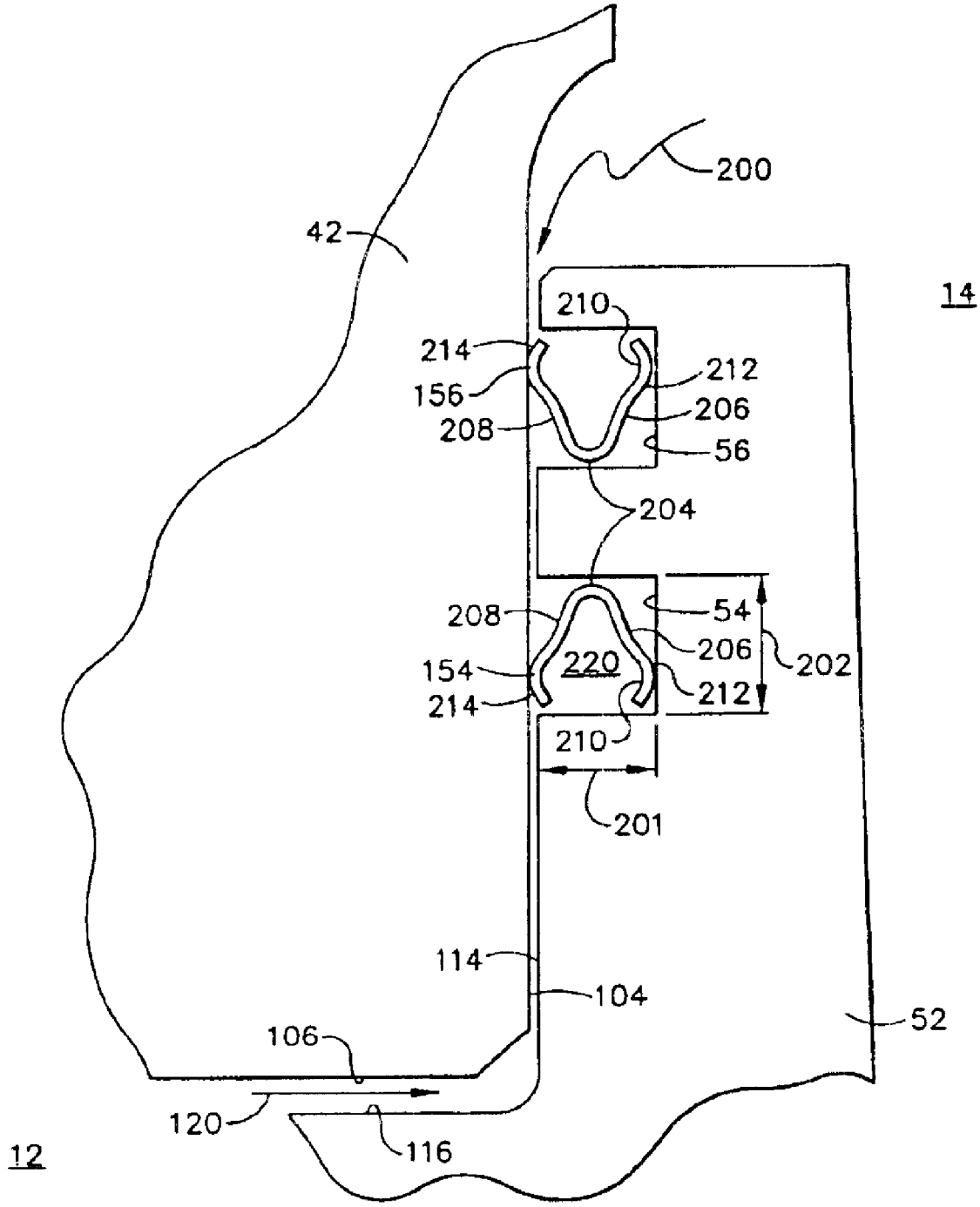
FIG. 3 is an enlarged view of the section divider shown in FIG. 1 and taken along area 3.

FIG. 3 is an enlarged view of section divider 42 taken along area 3. More specifically, FIG. 3 is an enlarged view of seal assembly 122. Section divider 42 is coupled to packing casing 52 such that corresponding sides 106 and 116 are proximate each other, and corresponding sides 104 and 114 are proximate each other. Gaps 119 and 118 are defined between sides 104 and 114, and between sides 106 and 116, respectively. Gaps 119 and 118 permit steam from HP section 12 to leak toward IP section 14 through leakage path 120 during operation of turbine 10. A second leakage path 200 is a reverse flow path that may occur during some turbine operations, such as, for example, a turbine trip. To facilitate reducing or eliminating steam leakage through paths 120 and 200, sealing members 154 and 156 are positioned in grooves 54 and 56 in side 114. Each seal groove 54 and 56 is defined by a groove depth 201 and a groove width 202. In the exemplary embodiment, each groove depth 201 and groove width 202 are between approximately 0.2 inches and approximately 0.5 inches. In the exemplary embodiment, sealing members 154 and 156 are V-seals. More specifically, each sealing member 154 and 156 has a cross-sectional profile including an apex 204 and a pair of opposed legs 206 and 208 that diverge from apex 204. Legs 206 and 208 form an interior surface 210 and an exterior surface 212. Sealing members 154 and 156 are sized such that at least a portion of leg 208 extends past side 114 into leakage paths 120 and 200 such that when section divider 42 and channel 50 are coupled, leg 208 at least partially engages side 104.

Sealing members 154 and 156 are fabricated from a material that provides flexibility at apex 204 and rigidity of legs 206 and 208 to withstand a pressure differential across legs 206 and 208. In the exemplary embodiment, members 154 and 156 withstand a pressure differential of at least approximately 600 kPa. In the exemplary embodiment, sealing members 154 and 156 are fabricated from rolled sheet metal having a thickness of between about 0.005 inches and 0.030 inches. In other embodiments, sealing members 154 and 156 are fabricated from materials such as, for example, Hastelloy ®, Cres 304, and Incoloy 909 ®. Sealing members 154 and 156 are positioned in their respective grooves 54 and 56 such that apexes 204 point toward each other, giving sealing members 154 and 156 an opposed configuration with respect to each other. In another embodiment, sealing members 154 and 156 are E, W, or C seals wherein the open side of each E, W, or C face away from each other. In one embodiment, sealing members 154 and 156 are commercially available from Jetseal, Inc. of Spokane, Wash. In the exemplary embodiment, sealing members 154 and 156 are identical to each other. In another embodiment, sealing members 154 and 156 are different.

In operation, steam from HP section 12 attempts to flow to lower pressure IP section 12 during normal operation of turbine 10. As steam flows through leakage path 120, the steam contacts sealing member interior surface 210. Leg exterior surface 212 contacts side 104 due to the flexibility of apex 204 and thus provides a bias to leg 208. A distal end 214 of leg 208 blocks steam flow from leakage path 120 and directs the steam towards an area 220 defined within interior surface 210 of sealing member 154. A differential pressure builds up across sealing member 154 due to steam from HP section 12 becoming trapped in area 220 and leakage path 120 downstream of sealing member 154 still being in communication with IP section 14. The differential pressure across sealing member 154 causes legs 206 and 208 to expand outwardly further tightening the contact between exterior surface 212 of sealing member 154 and side 104.

During operations when the differential pressure tends to reverse, for example during a turbine trip event, sealing member 156 will activate to block leakage path 200 in a manner similar to that of sealing member 154 blocks leakage flow through path 120 during normal turbine operations. Thus, a double seal arrangement in an area of the steam turbine where surface irregularities may provide a leakage path from HP section 12 to IP section 14 facilitates reducing leakage through path 120 during normal operation of turbine 10 and during upsets when steam flow may reverse.

The above-described turbine casing seal arrangement is cost effective and highly reliable. The double seal arrangement includes a first sealing member to facilitate reducing steam leakage through an internal leakage path in the turbine during normal operations and a second sealing member in an opposed arrangement from the first sealing member to facilitate reducing steam leakage in an opposite direction through an internal leakage path in the turbine during other than normal operations. As a result, the turbine casing seal arrangement facilitates reducing steam leakage in a turbine during a plurality of modes of operation in a cost effective and reliable manner.

Exemplary embodiments of turbine casing seal arrangements are described above in detail. The arrangements are not limited to the specific embodiments described herein, but rather, components of the system may be utilized independently and separately from other components described herein. Each turbine casing seal arrangement component can also be used in combination with other turbine casing seal arrangement components.

While the invention has been described in terms of various specific embodiments, those skilled in the art will recognize that the invention can be practiced with modification within the spirit and scope of the claims.

What is claimed is:

1. A method of assembling a steam turbine, said method comprising:

positioning a first sealing member in a leakage path defined between an inner casing and an outer casing of said steam turbine such that leakage flow in a first direction activates the first sealing member; and positioning a second sealing member in the leakage path such that leakage flow in the first direction bypasses the second sealing member, and such that leakage flow in an opposite second direction activates the second sealing member.

2. A method in accordance with claim 1 wherein positioning a first sealing member comprises positioning the first sealing member in a first groove formed in a channel defined in the inner casing.

3. A method in accordance with claim 2 wherein the first sealing member includes a pair of substantially semi-circular portions and wherein positioning a first sealing member comprises positioning a first portion of the first sealing member in the first groove, and positioning a second portion of the first sealing member in the first groove.

4. A method in accordance with claim 2 wherein positioning a first sealing member comprises positioning at least one of a V-seal, an E-seal, a W-seal, and a C-seal in the first groove.

5. A method in accordance with claim 2 wherein positioning a second sealing member comprises positioning the second sealing member in a second groove formed in the channel defined in the inner casing.

6. A method in accordance with claim 5 wherein the second sealing member includes a pair of substantially semi-circular portions and wherein positioning a second sealing member comprises positioning a first portion of the second sealing member in the second groove, and positioning a second portion of the second sealing member in the second groove.

7. A method in accordance with claim 5 wherein positioning a second sealing member comprises positioning at least one of a V-seal, an E-seal, a W-seal, and a C-seal in the second groove.

8. A seal assembly for sealing a leakage path, said seal assembly comprising:

a first groove defined in a channel;

a second groove defined in said channel and substantially parallel to said first groove, said second groove radially outward from said first groove;

a divider positioned in said channel such that a gap defined between said divider and said channel defines a leakage path;

a first sealing member extending at least partially within said first groove and positioned to substantially prevent a flow within said leakage path in a first direction; and a second sealing member extending at least partially within said second groove and positioned to substantially prevent a flow within said leakage path in a second direction, said second direction opposite to said first direction.

9. A seal assembly in accordance with claim 8 wherein said leakage path is defined between a high pressure (HP) turbine section and intermediate pressure (IP) turbine section of an HP/IP turbine.

10. A seal assembly in accordance with claim 8 wherein said channel is formed in a circumferential extension of a turbine inner casing.

11. A seal assembly in accordance with claim 8 wherein said first sealing member and said first sealing member comprise at least one of a V-seal, an E-seal, a W-seal, and a C-seal.

12. A seal assembly in accordance with claim 8 wherein said first sealing member and said second sealing member each comprise a plurality of circumferential segments.

13. A seal assembly in accordance with claim 8 wherein said first and second sealing members each comprise a pair of substantially semi-circular portions.

14. A rotary machine comprising:

a rotor rotatable about a longitudinal axis and comprising an outer annular surface;

an annular outer casing comprising an inner surface, said outer casing spaced radially outwardly from said rotor, said casing inner surface comprising a first extension extending radially inwardly towards said rotor, said first extension extending circumferentially about said casing inner surface;

a cylindrical inner casing comprising an outer surface, said outer surface comprising a second extension extending radially towards said outer casing, said second extension extending circumferentially about said outer surface, said second extension comprising a channel in an outer extension surface for receiving said first extension when said outer casing and said inner casing are assembled;

a first groove formed in said channel sized to receive a sealing member; and a sealing member positioned at least partially within said first groove for sealing a leakage path.

15. A rotary machine in accordance with claim 14 further comprising:

a second groove formed in said channel substantially parallel to said first groove, said second groove sized to receive a sealing member; and a sealing member positioned at least partially within said second groove for sealing the leakage path.

16. A rotary machine in accordance with claim 15 wherein leakage flow in a first direction activates said sealing member positioned in said first groove, and leakage flow in a second direction activates said sealing member positioned in said second groove.

17. A rotary machine in accordance with claim 16 comprising an opposed flow HP/IP turbine rotor.

18. A rotary machine in accordance with claim 16 wherein said leakage path is defined between a high pressure (HP) turbine section and intermediate pressure (IP) turbine section of an HP/IP turbine.

19. A rotary machine in accordance with claim 16 wherein said sealing members comprise at least one of a V-seal, an E-seal, a W-seal, and a C-seal.

20. A rotary machine in accordance with claim 16 wherein said sealing members comprise a plurality of circumferential segments.

* * * * *